US009617139B2

(12) United States Patent
Hoover

(10) Patent No.: US 9,617,139 B2
(45) Date of Patent: Apr. 11, 2017

(54) BEVERAGE DISPENSING SYSTEM USING HIGHLY CONCENTRATED BEVERAGE SYRUP

(71) Applicant: Cornelius, Inc., St. Paul, MN (US)

(72) Inventor: George Harold Hoover, Carmel, CA (US)

(73) Assignee: IMI Cornelius, Inc., Glendale Heights, IL (US)

( * ) Notice: Subject to any disclaimer, the term of this patent is extended or adjusted under 35 U.S.C. 154(b) by 0 days.

(21) Appl. No.: 14/667,143

(22) Filed: Mar. 24, 2015

(65) Prior Publication Data

US 2015/0197416 A1 Jul. 16, 2015

Related U.S. Application Data

(63) Continuation of application No. 14/193,896, filed on Feb. 28, 2014, now Pat. No. 9,010,577, which is a continuation of application No. 14/047,572, filed on Oct. 7, 2013, now Pat. No. 8,701,937, which is a continuation of application No. 12/733,999, filed as application No. PCT/US2008/011745 on Oct. 15, 2008, now Pat. No. 8,567,642.

(60) Provisional application No. 60/998,971, filed on Oct. 15, 2007.

(51) Int. Cl.
*B67D 1/00* (2006.01)

(52) U.S. Cl.
CPC ..... *B67D 1/0034* (2013.01); *B67D 1/0021* (2013.01); *B67D 1/0029* (2013.01); *B67D 1/0043* (2013.01); *B67D 1/0044* (2013.01)

(58) Field of Classification Search
USPC ..... 222/129.1–129.4, 145.1, 145.5, 145.6, 222/146.6, 134, 135
See application file for complete search history.

(56) References Cited

U.S. PATENT DOCUMENTS

| | | | | |
|---|---|---|---|---|
| 4,986,447 | A * | 1/1991 | McCann | B67D 1/005 222/129.1 |
| 5,203,474 | A * | 4/1993 | Haynes | B67D 1/005 222/129.1 |
| 5,603,257 | A * | 2/1997 | Kateman | A23G 9/04 62/306 |
| 2004/0040983 | A1* | 3/2004 | Ziesel | B67D 1/0051 222/129.1 |
| 2005/0269360 | A1* | 12/2005 | Piatnik | B67D 1/0051 222/129 |
| 2007/0131715 | A1* | 6/2007 | Minard | B67D 1/0044 222/145.5 |
| 2008/0093382 | A1* | 4/2008 | Sher | B67D 1/0021 222/129.1 |

* cited by examiner

*Primary Examiner* — Donnell Long
(74) *Attorney, Agent, or Firm* — Niro, Haller & Niro

(57) ABSTRACT

A fountain beverage dispenser for constituting a beverage by mixture of a beverage syrup and a diluent for the syrup is characterized by use of a highly concentrated beverage syrup supply and at least one diluent and syrup blending station for diluting the highly concentrated syrup with diluent before the diluted syrup is mixed with diluent in the final mixture of syrup and diluent delivered to a dispensing nozzle.

16 Claims, 3 Drawing Sheets

BEVERAGE DISPENSING SYSTEM USING HIGHLY CONCENTRATED BEVERAGE SYRUP

This is a continuation of application Ser. No. 14/193,896 filed Feb. 28, 2014, which is a continuation of Ser. No. 14/047,572 filed Oct. 7, 2013, now U.S. Pat. No. 8,701,937, which is a continuation of Ser. No. application 12/733,999 filed Apr. 2, 2010, now U.S. Pat. No. 8,567,642, which was a U.S. entry of PCT/US2008/011745 filed Oct. 15, 2008 which claimed priority to U.S. Provisional application 60/998,971 filed Oct. 15, 2007. Applications Ser. No. 14/193,896, Ser. No. 14/047,572, Ser. No. 12/733,999, PCT/US2008/011745 and 60/998,971 are hereby incorporated by reference in their entireties.

FIELD OF THE INVENTION

The present invention relates to fountain beverage dispensing system, and in particular to a fountain beverage dispensing system using a high ratio of diluent to syrup in constituting a beverage.

BACKGROUND OF THE INVENTION

Fountain or post-mix beverage dispensing systems are well known and in common use around the world. It is estimated that more than 200,000 outlets in the U.S. alone dispense fountain products.

A fountain beverage dispensing system commonly includes one or more syrup 20 supplies, which typically are concentrate beverage syrups provided in bag-in-box packaging, along with syrup pumps, a carbonator, supply tubing, a chilling system, ratio or flow control devices for beverage components and beverage dispensing nozzles. Sugar based beverage concentrate syrups are typically supplied at a Brix of 50 to 63, the upper limit of which is determined by the viscosity of the syrup. Viscosities of syrups greater than the mid-60's Brix are too high to be handled in conventional fountain beverage dispensing systems due to the high pressure drops incurred by syrup as it flows through the system. High pressure drops result in slow or inadequate syrup flow rates and inadequate pressure at a syrup flow control device to enable the device to function properly and maintain a desired flow rate of the syrup so that, along with a flow control device for diluent, a desired diluent/syrup ratio of the beverage components is delivered to a dispense valve. A typical diluent/syrup ratio for a beverage mixture is on the order of about 5 parts diluent (commonly plain or carbonated water) to 1 part syrup.

Diet or sugar-free syrups are not limited by viscosity. Sugar-free syrup does not increase in viscosity as it is made more highly concentrated, and can be concentrated to the extent that, in theory, a fountain beverage could be reconstituted using a diluent/syrup ratio on the order of 50:1 or more. However, such a high diluent/sugar-free syrup ratio is not used in practice due to the difficulties of controlling the flow rate of syrup to provide a 50:1 ratio, since that would require a flow rate of syrup, relative to diluent, that is so low as to be difficult to control. Existing flow rate controllers have the capability of being adjusted to dispense higher diluent/syrup ratios than 5:1, and most can be adjusted to accurately dispense a diluent/syrup ratio of up to 8:1.

In excess of 500,000,000 gallons of concentrate beverage syrup is dispensed annually in the U.S. As syrup is typically packaged in 5 gallon bag-in-box containers, more than 100,000,000 bag-in-box packages are used annually for syrup. The cost per bag-in-box is presently more than $4.00 when package, manufacturing, and distribution costs are considered.

If fountain beverage dispensing systems were able to handle more concentrated beverage syrups having higher Brix values, so that the diluent/syrup ratio could be greater than 5:1, that would enable more drinks to be provided per bag-in-box package of syrup. That, in turn, would reduce the number of bag-in-box syrup packages used annually. However, as noted above a limiting factor in using more highly concentrated sugar based syrups to increase the diluent/syrup ratio is the inability of flow controllers to accurately control the flow rate of a highly viscous syrup. Also, while sugar-free or diet syrups do not suffer increasing viscosity problems with increases in concentration, there is a practical limit to how highly concentrated a syrup can be and still have its flow rate controlled for obtaining accurate diluent/syrup ratios.

In addition to saving bag-in-box packaging costs, an ability to use more highly concentrated syrups would increase the number of beverages that could be served from a bag-in-box package and reduce the number of bag-in-box changes that are required for service of a given number of drinks.

Another important consideration concerning post-mix beverage dispensing systems is growth of organisms, giving rise to the requirement to sanitize the systems. Currently, the acidity of syrups inhibits the growth of organisms, so the syrup circuits of the systems do not normally require sanitization. However, diluting syrups too much will decrease their acidity level and open the possibility of organism growth in syrup circuits, as is experienced with pre-mix beverage dispensers that are supplied with fully mixed, ready to drink beverages.

OBJECT OF THE INVENTION

A primary object of the present invention is to provide a fountain beverage dispensing system that can dispense a beverage mixture having a higher diluent/syrup ratio, and that uses a more highly concentrated beverage syrup, than is the case with conventional beverage dispensing systems.

SUMMARY OF THE INVENTION

In accordance with the present invention, a fountain beverage dispensing system comprises a beverage dispense nozzle; diluent flow control means for being fluid coupled to a supply of a first diluent and controllable to deliver to the nozzle a metered flow of the first diluent; beverage syrup flow control means for being fluid coupled to a supply of beverage syrup and controllable to deliver to the nozzle a metered flow of the beverage syrup; and means for diluting the beverage syrup with a second diluent before the beverage syrup is received by the beverage syrup flow control means.

In preferred embodiments of the fountain beverage dispensing system of the invention, one of the first and second diluents is plain water and the other is carbonated water, or each of the first and second diluents is plain water, or each of the first and second diluents is carbonated water. Also, a chiller is fluid coupled between the supply of the first diluent and the diluent flow control means, and between the supply of the beverage syrup and the beverage syrup flow control means, for chilling the first diluent and the beverage syrup respectively fluid coupled to the diluent flow control means and the beverage syrup flow control means. The means for diluting the beverage syrup with the second diluent can be fluid coupled between the supply of the beverage syrup and the chiller, which may be preferred where the supply of the beverage syrup is a sugar based beverage syrup having a Brix on the order of at least 65, or a Brix between about 65 and 80, or a Brix between about 75 and 80.

Alternatively, the means for diluting the beverage syrup with the second diluent can be fluid coupled between the chiller and the beverage syrup flow control means, which may be preferred where the beverage syrup is a sugar-free beverage syrup having a concentration that requires a water/syrup ratio on the order of at least 8.5:1 to 15:1 to properly constitute a beverage.

For the case where the beverage syrup has a high viscosity, the means for diluting the beverage syrup with the second diluent can be fluid coupled between the supply of the beverage syrup and the chiller relatively close to the supply of the beverage syrup. In this case, a syrup pump can be fluid coupled between the supply of the beverage syrup and the means for diluting the beverage syrup for pumping the viscous beverage syrup from the supply of beverage syrup to the means for diluting the beverage syrup. Advantageously, a second syrup pump can be fluid coupled between the means for diluting the beverage and the beverage syrup flow control means for pumping diluted beverage syrup from the means for diluting to the syrup flow control means.

The invention also contemplates a method of dispensing a fountain beverage, which comprises the steps of delivering a first diluent from a supply thereof through a diluent flow rate controller to a beverage dispense nozzle; delivering beverage syrup from a supply thereof through a beverage syrup flow rate controller to the dispense nozzle; and diluting the beverage syrup with a second diluent before the beverage syrup is delivered to the beverage syrup flow rate controller.

In preferred practices of the method, included is the step of operating each of the diluent flow rate controller and the beverage syrup flow rate controller to deliver the first diluent and syrup to the beverage nozzle in a selected first diluent; syrup ratio, and one of the first and second diluents can be plain water and the other carbonated water, or each of the first and second diluents can be plain water, or each of the first and second diluents can be carbonated water. In addition, included are the steps of chilling the first diluent before the first diluent is delivered through the diluent flow rate controller, and chilling the beverage syrup before the beverage syrup is delivered through the beverage syrup flow rate controller.

The step of diluting the beverage syrup with the second diluent can be performed before performance of the step of chilling the beverage syrup, which is advantageous when the beverage syrup is a high viscosity sugar based beverage syrup having a Brix of at least 65, or a Brix between about 65 and 80, or a Brix between about 75 and 80. Alternatively, in the case of a sugar-free syrup, the step of diluting the beverage syrup with the second diluent can be performed after performance of the step of chilling the beverage syrup and before the step of delivering the beverage syrup through the beverage syrup flow rate controller.

For the situation where the beverage syrup is highly viscous, the diluting step advantageously is performed close to the supply of beverage syrup and along a beverage syrup flow path extending between the supply of beverage syrup and the beverage syrup flow rate controller, and included is the step of pumping beverage syrup from the beverage syrup supply to the point along the syrup flow path where the diluting step is performed. It may be desirable to include the step of pumping the diluted beverage syrup from the point along the beverage syrup flow path where the diluting step is performed to the beverage syrup flow rate controller.

DETAILED DESCRIPTION

Figure 1:
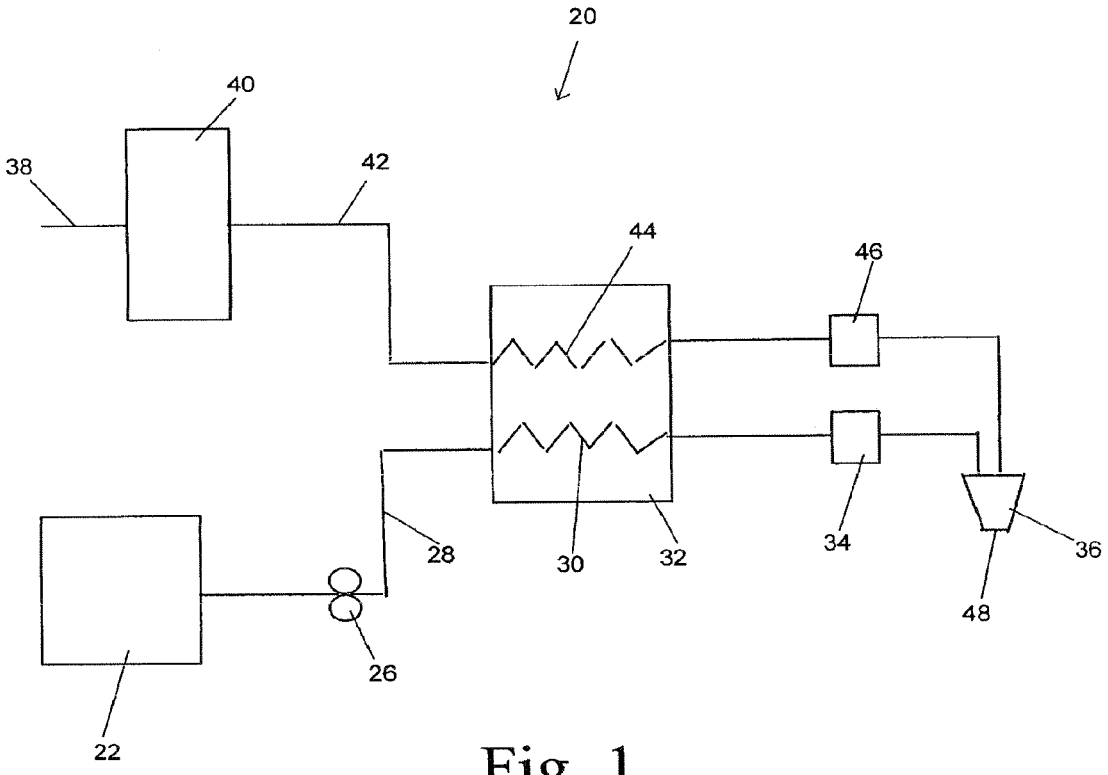
Fig. 1 (Prior Art)
FIG. 1 is a schematic representation of a conventional fountain beverage dispensing system.

A schematic representation of a conventional fountain beverage dispensing system is shown in FIG. 1 and indicated generally at 20. In such beverage system, concentrate beverage syrup from a supply 22 of syrup, which supply normally is in bag-in-box packages, is delivered by a syrup pump 26 through tubing 28 to and through a circuit 30 of a chiller 32. The chiller 32 may be a water bath chiller or a cold plate, and from the chiller syrup flows to a syrup flow control device 34. The syrup pump 26 propels the syrup through the chiller circuit 30 to desirably chill the syrup to near 32° F., and then to the syrup flow control device 34, which requires a syrup pressure on the order of about 20 psig or more to accurately meter the flow rate of the syrup as delivered to a post-mix beverage dispense nozzle 36. While only a single syrup supply 22 and associated syrup flow circuit is shown, it is understood that fountain beverage dispensers normally include a plurality of such syrup supplies and associated syrup flow circuits.

A water line 38, which usually connects to a city main, delivers water to an inlet to a carbonator 40, within which water is carbonated in a manner well understood in the art. Carbonated water exiting the carbonator 40 flows through tubing 42 to and through at least one circuit 44 of the chiller 32, within which it is desirably chilled to a temperature near 32° F. Upon exiting the chiller, the carbonated water flows to and through a water flow control device 46 to the beverage dispense nozzle 36. As is understood, the syrup and water flow rate controllers 34 and 46 operate to meter the flow rates of syrup and water so that a selected ratio of water and syrup is delivered to the dispensing nozzle 36 for exit through an outlet 48 from the nozzle and introduction into a cup positioned beneath the nozzle.

Syrup pumps typically have a shortened life if they operate at a pressure in excess of 75-80 psig. Using this maximum pressure as an upper pressure limit for the syrup pump 26 and a required pressure of 20 psig at the syrup flow control device 34, a maximum pressure drop of 60 psig is allowed in the system between the syrup pump and the flow control device. Given the vagaries of installations of different beverage dispensing systems, a maximum pressure drop nearer 40 psig is desired. Syrups with Brix level in the mid 60s have viscosities that result in pressure drops near the upper end of acceptable pressure drops. Higher viscosity syrups are not suitably dispensed due to excessive pressure drops or reduced flow rates.

Consequently, sugar based beverage concentrate syrups are typically supplied at a Brix of 50 to 63, the upper limit of which is determined by the maximum useful viscosity of the syrup. Syrups with viscosities greater than the mid-60's Brix are simply too viscous to be properly handled in conventional beverage dispensing systems due to the high pressure drops incurred in the syrups as they £low through the syrup circuits. High pressure drops result in slow or inadequate syrup flow rates and unacceptable beverage dispense times. High pressure drops also result in inadequate pressure of syrup at the flow control device for the syrup, which does not enable the flow control device to function properly and accurately meter a desired flow rate of the syrup, so that a selected diluent/syrup ratio of the beverage is delivered to the dispense nozzle. A typical diluent/syrup ratio for a beverage mixture is on the order of about 5 parts diluent {commonly plain or carbonated water) to 1 part syrup. At higher diluent/syrup ratios, the increased viscosity of the syrup makes it difficult., if not impossible, to maintain a desired diluent/syrup ratio.

Sugar-free or diet syrups, on the other hand, do not exhibit increases in viscosity with increases in concentration. However, there is a practical limit to how concentrated a sugar-free syrup concentrate can be, because at very high concentrations of the syrup it becomes difficult for the water and syrup flow control rate devices to accurately meter the syrup so as to maintain a desired diluent/syrup ratio.

Figure 2:
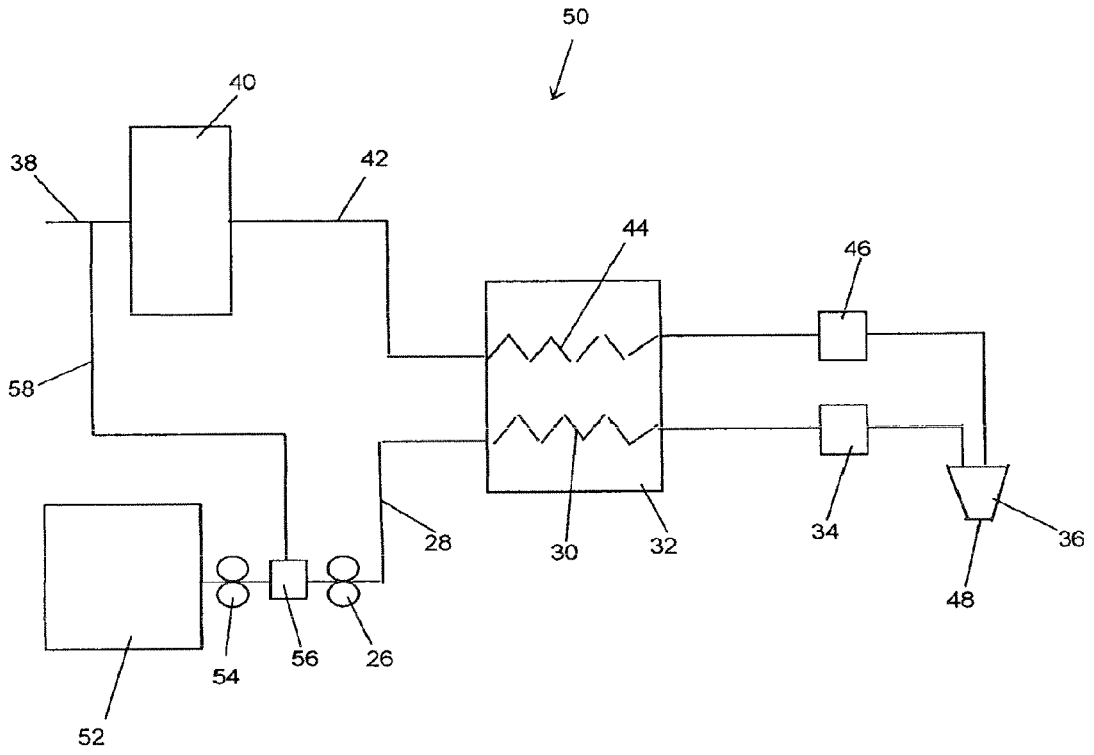
FIG. 2 is a schematic representation of a fountain beverage dispensing system embodying the teachings of the present invention, as may be used with a highly concentrated sugar based syrup.

FIG. 2 is a schematic representation of a fountain beverage dispensing system, indicated generally at 50, that embodies the teachings of the present invention and is of a type as may be supplied with a highly concentrated sugar based beverage syrup, such for example as a 75-80 Brix syrup. The system 50 is similar to and embodies much of the structure of the beverage system 20 of FIG. 1, and like reference numerals have been used to identify like components. In differing from the conventional beverage dispensing system 20, the dispensing system 50 receives beverage syrup from a supply 52 of 75-80 Brix sugar based beverage syrup, which is very viscous and would not be suitable for use in the conventional system. To enable such viscous syrup to be used in the dispensing system 50, the system is provided with a second syrup pump 54 that is located close to the syrup supply 52 and that delivers syrup from the syrup supply to a syrup inlet to a water and syrup blender 56, a water inlet to which is fluid coupled to the water line 38 through a line 58. The water and syrup blender 56 introduces water into the highly viscous syrup delivered by the pump 54 and blends the water and syrup together in a selected water/syrup ratio for delivery of diluted syrup from an outlet from the blender to the pump 26. The water and syrup blender 56 may comprise a water metering device and a syrup metering device that meter and bring together the water and syrup in a selected ratio, thereby to dilute the syrup and decrease its viscosity so that it might be pumped through the beverage dispensing system by the pump 26 and brought together with carbonated water at the dispense nozzle 36.

The diluted syrup exiting the water and syrup blender 56 may have the same concentration as syrups conventionally used, or it may have a reduced concentration, with the water and syrup flow control devices 46 and 34 being operated, in accordance with the concentration of the syrup, to provide at the dispense nozzle 36 a water/syrup ratio on the order of 4.75:1 to 5:1. A key consideration, however, is that excessive dilution of the syrup does not occur at the water and syrup blender 56, and in particular that the syrup concentrate not be diluted to an extent that its acidity and other factors are no longer strong enough to restrict the growth of organisms.

It is to be appreciated that in the absence of the water and syrup blender 56 added to the dispensing system according to the teachings of the invention, which provides a diluted and less viscous syrup to be delivered by the. syrup pump 26, the syrup pump 26 would not be capable of pumping the highly viscous syrup from the supply 52 through the beverage dispensing system with sufficient pressure for the syrup flow control 34 to accurately meter the flow rate of syrup delivered to the dispense nozzle 36. It also is to be appreciated that while the pump 54 can be of the same type as the pump 26, it is effective to deliver syrup to the water and syrup blender 56 because it is located at or close to the outlet from the syrup supply 52 and close to the blender, such that it does not have to develop a significant pressure of the syrup to deliver the syrup the limited distance to and through the blender.

Figure 3:
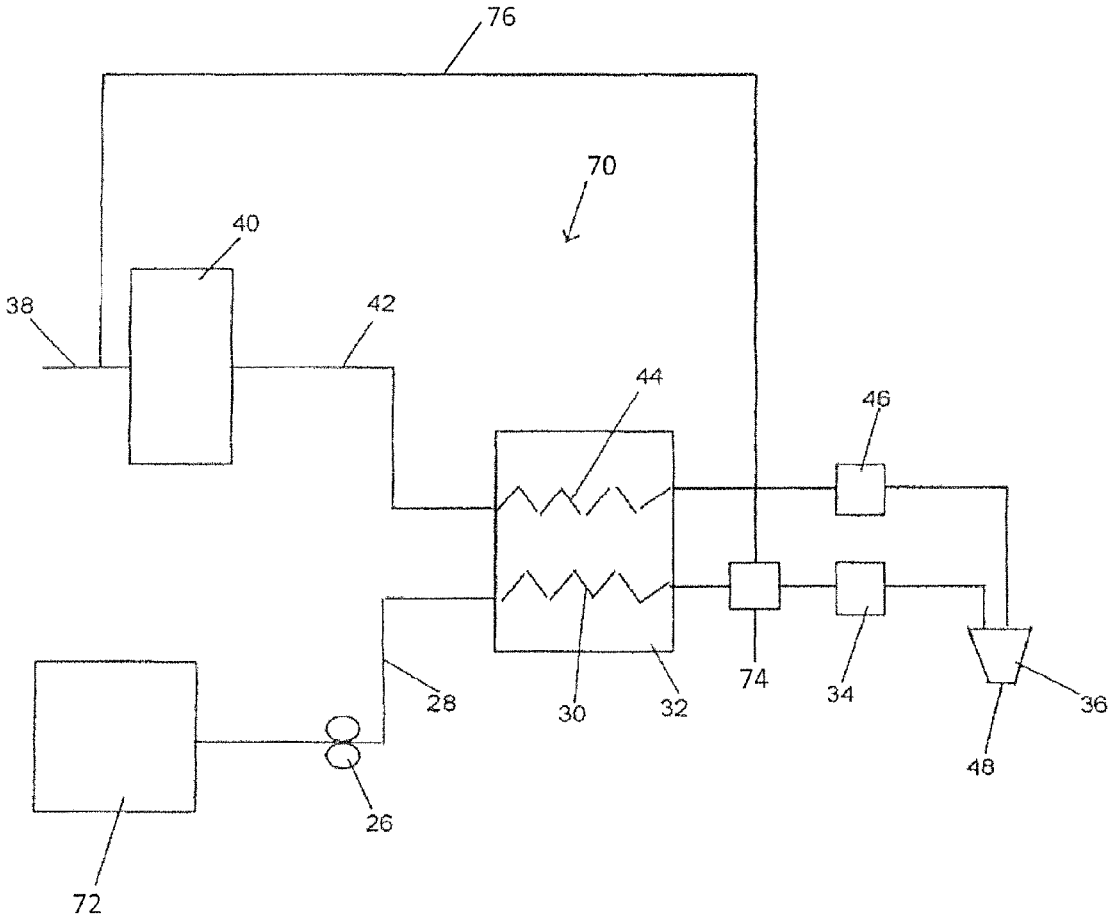
FIG. 3 is a schematic representation of a fountain beverage dispensing system embodying the teachings of the present invention, as may be used with a highly concentrated sugar-free or diet syrup

FIG. 3 is a schematic representation of a further embodiment of fountain beverage dispensing system, indicated generally at 70, that embodies the teachings of the present invention and is of a type as may be supplied with a highly concentrated sugar-free or diet beverage syrup, such for example as a concentrated sugar-free syrup that would require a water/syrup ratio on the order of 15:1 or more to properly reconstitute a beverage. The system 70 is similar to and embodies much of the structure of the conventional beverage system 20 of FIG. 1, and like reference numerals have been used to denote like components. In differing from the conventional beverage dispensing system 20, the dispensing system 70 receives highly concentrated sugar-free beverage syrup from a supply 72, which because it is sugar-free does not have a viscosity that increases with concentration. The syrup is delivered from the supply 72 by the pump 26 to and through the circuit 30 of the chiller 32 to an inlet to a water and syrup blender 74, a water inlet to which blender is fluid coupled to the water line 38 through a line 76. The water and syrup blender 74 introduces water into the syrup delivered by the pump 26 and blends the water and syrup together in a selected water/syrup ratio for delivery of diluted syrup from an outlet from the blender to the syrup flow control device 34. The water and syrup blender 74 may comprise a water metering device and a syrup metering device that bring the water and syrup together in a selected ratio, thereby to dilute the syrup and increase the volume of syrup required to constitute a beverage, sa that the syrup might be more accurately metexed by the syrup flow controller 34.

The syrup exiting the water and syrup blender 74 may have the same concentration as would sugar-free syrup used in the conventional beverage dispensing system 20 of FIG. 1, or it may have a reduced concentration, with the water and syrup flow control devices 46 and 34 being operated, in accordance with the concentration of the syrup, to provide at the dispense nozzle 36 a water/syrup ratio on the order of 4.75:1 to 5:1. A key consideration, again, is that excessive dilution of the syrup does not occur at the water and syrup blender 74, and in particular that the sugar-free syrup concentrate not be diluted to an extent that its acidity and other factors are no longer strong enough to restrict the growth of organisms.

It is to be appreciated that because the particular concentration of sugar-free syrup does not affect its viscosity, the water and syrup blender 74 need not be located close to the syrup supply. Also, a separate pump need not be provided to propel the syrup to the blender. Instead, the blender can be located as s~own, downstream from the chiller 32 and close to the dispense nozzle 36. On the other hand, it is not necessary that the water and syrup blender 74 be located downstream from the chiller, and if desired the blender can be located elsewhere in the syrup flow path, for example close.to the outlet from the syrup supply 72.

While in each of FIGS. 2 and 3 there is only one syrup dilution station, it is contemplated that there can be multiple syrup dilution stations for a single beverage disperlser, since depending on the concentration of the syrup and particularly if the syrup is very highly concentrated, for accuracy in dilution of the syrup it may be desirable to dilute the syrup at two or more dilution stations before it is delivered through the syrup flow rate controller 34 to the beverage dispense nozzle.

It is to be appreciated that the invention teaches the provision of water and syrup blending stations or syrup dilution stations in fountain beverage dispensers to overcome existing barriers to using highly concentrated beverage syrups. As mentioned, a requirement is the limitation of the dilution of syrups only to levels that will not support the growth of organisms. This may require two or more dilution steps.

Is also is to be appreciated that while the invention has been described in terms of diluting a syrup with plain water, it is contemplated that carbonated water may be used. Further, preservatives may be introduced into the water used to dilute the syrup, and heating of the syrup at or near a first stage of dilution may be utilized to reduce the possibility of organism growth in the event of occurrence of pockets of mixture at non-desired low ratio levels.

Advantages of the present invention include reducing the number of bag-inbox syrup packages a beverage company is required to utilize in order to dispense a given number of finished beverages, which not only decreases costs, but is also environmentally friendly. Using a fountain beverage dispensing system that utilizes 15:1 non-sugar syrup concentrates and 75 to 80 Brix sugar syrup concentrates will save beverage companies bag-in-box packaging usage by up to 50%, versus using a beverage syrup concentrate that provides the current 4.75:1 ratios. This reduction of bag-in-box packaging usage could, at present day costs, allow syrup company to realize annual cost reductions in excess of $100,000,000. Savings at the outlet level would also be realized since 30-50% fewer bag-in-box packages would need to changed.

While embodiments of the invention have been described in detail, various modi6cations and other embodiments thereof may be devised by one skilled in the art without departing from the spirit and scope of the invention, as defined in the appended claims.

The invention claimed is:

1. A method for dispensing a fountain beverage comprising:

dispensing a highly concentrated sugar-based syrup supply containing a sugar-based beverage syrup at more than approximately 65° brix;

mixing said highly concentrated sugar-based syrup supply with a first diluent, in close proximity to said dispensing of said highly concentrated sugar-based syrup supply, to a selected diluent to syrup ratio such that the syrup/diluent ratio maintains the acidity level to restrict the growth of organisms;

mixing in a nozzle a second diluent supply with the syrup/diluent to further dilute the sugar-based syrup and first diluent mixture to create a beverage.

2. The method for dispensing a fountain beverage of claim 1, wherein the sugar-based beverage syrup has a brix between 65 and 80.

3. The method for dispensing a fountain beverage of claim 1, wherein said sugar-based beverage syrup has a brix between 75 and 80.

4. The method for dispensing a fountain beverage of claim 1, further including the step of pumping the highly concentrated syrup supply to the mixing of said highly concentrated sugar-based syrup supply with said first diluent.

5. The method for dispensing a fountain beverage of claim 4, wherein the mixing of said highly concentrated sugar-based syrup supply with said first diluent further includes the metering of said first diluent and metering of said second diluent to the first diluent and sugar-based beverage syrup in the selected ratio.

6. The method for dispensing a fountain beverage of claim 5, further comprising the step of selecting a ratio on the order of approximately 5:1.

7. The method for dispensing a fountain beverage of claim 5, further including the step of metering the step of selecting said ratio on the order of approximately 2:1.

8. The method for dispensing a fountain beverage of claim 4, further including the step of pumping the mixture of the first diluent and highly concentrated sugar-based syrup supply downstream of the mixing step.

9. A method for dispensing a fountain beverage comprising:

dispensing a highly concentrated sugar-free syrup supply containing a sugar-free beverage syrup at greater than a 15 to 1 water to syrup ratio;

first mixing a first diluent with said sugar-free beverage syrup in a selected water to syrup ratio to no less than an acidity level to restrict the growth of organisms;

second mixing a second diluent at a nozzle to further dilute the sugar-free beverage syrup and first diluent mixture to create a beverage.

10. The method for dispensing a fountain beverage of claim 9, further including the step of pumping the highly concentrated sugar-free syrup supply to the first mixing step.

11. The method for dispensing a fountain beverage of claim 9, further including the step of metering the first diluent and metering the highly concentrated sugar-free syrup supply to control the first diluent and sugar-based beverage syrup in the selected ratio.

12. The method for dispensing a fountain beverage of claim 11, wherein the selected ratio is on the order of approximately 5:1.

13. The method for dispensing a fountain beverage of claim 11, wherein the selected ratio is on the order of approximately 2:1.

14. The method for dispensing a fountain beverage of claim 11 wherein the first and second diluents are carbonated water.

15. The method for dispensing a fountain beverage of claim 11 wherein the first and second diluents are plain water.

16. The method for dispensing a fountain beverage of claim 11 wherein the first and second diluents are plain water and the other is carbonated water.

* * * * *